US010232228B2

(12) United States Patent
Eaglin et al.

(10) Patent No.: US 10,232,228 B2
(45) Date of Patent: Mar. 19, 2019

(54) SPORTS BALL FUNNELING NET WITH RELEASABLE RESTRAINING ELEMENT

(71) Applicant: E3 High Performance Baseball Corp., Studio City, CA (US)

(72) Inventors: Michael Eaglin, Studio City, CA (US); Jeffrey Sehgal, La Jolla, CA (US)

(73) Assignee: E3 High Performance Baseball Corp., Studio City, CA (US)

( * ) Notice: Subject to any disclaimer, the term of this patent is extended or adjusted under 35 U.S.C. 154(b) by 0 days.

(21) Appl. No.: 15/447,000

(22) Filed: Mar. 1, 2017

(65) Prior Publication Data

US 2017/0252610 A1 Sep. 7, 2017

Related U.S. Application Data

(60) Provisional application No. 62/302,081, filed on Mar. 1, 2016.

(51) Int. Cl.

| | |
|---|---|
| ***A63B 47/00*** | (2006.01) |
| ***A63B 47/02*** | (2006.01) |
| ***A63B 69/00*** | (2006.01) |
| ***A63B 71/02*** | (2006.01) |

(52) U.S. Cl.

CPC ..... *A63B 47/02* (2013.01); *A63B 47/002* (2013.01); *A63B 69/0002* (2013.01); *A63B 69/002* (2013.01); *A63B 71/022* (2013.01); *A63B 2069/0008* (2013.01); *A63B 2208/0204* (2013.01); *A63B 2209/10* (2013.01)

(58) Field of Classification Search

CPC ..... A63B 47/02; A63B 71/022; A63B 69/002; A63B 47/002; A63B 69/0002; A63B 2209/10; A63B 2208/0204; A63B 2069/0008

See application file for complete search history.

(56) References Cited

U.S. PATENT DOCUMENTS

| | | | | |
|---|---|---|---|---|
| 4,194,779 | A * | 3/1980 | Ouhashi | A63B 47/02 294/19.2 |
| 2009/0233738 | A1* | 9/2009 | Yu | A63B 24/0021 473/485 |
| 2015/0196819 | A1* | 7/2015 | Markham | A63B 71/0622 473/446 |
| 2015/0321065 | A1* | 11/2015 | Demarco | A63B 63/00 473/195 |

* cited by examiner

*Primary Examiner* — Gene Kim
*Assistant Examiner* — Jeffrey Vanderveen
(74) *Attorney, Agent, or Firm* — Mintz Levin Cohn Ferris Glovsky and Popeo, P.C.

(57) ABSTRACT

Described herein include various implementations of a ball funneling net that can capture sport balls, such as baseballs, directed into the ball funneling net. The ball funneling net can include a ball directing feature, such as a funnel, and a releasable restraining element that controls the sport balls from being released from the ball capturing net, such as from a distal dispensing end. In some implementations, a user can pick up a part of the ball directing feature and release the releasable restraining element thereby allowing any sport balls captured in the ball capturing net to exit the distal dispensing end. For example, the ball funneling net described herein can improve training efficiency in sports, such as baseball and softball, as well as reduce damage to equipment and improve user experience.

19 Claims, 2 Drawing Sheets

SPORTS BALL FUNNELING NET WITH RELEASABLE RESTRAINING ELEMENT

CROSS-REFERENCE TO RELATED APPLICATION

The current application claims priority under 35 U.S.C. § 119(e) to U.S. Provisional patent application Ser. No. 63/302,081, filed on Mar. 1, 2016 and entitled "Baseball Funneling Net With Releasable Closure," which is incorporated by reference herein in its entirety.

TECHNICAL FIELD

The subject matter described herein relates to implementations of a ball funneling apparatus having a releasable closure, with the ball funneling apparatus being configured to capture, collect, and dispense captured balls from the ball funneling apparatus.

BACKGROUND

Ball capture nets, particularly baseball hitting nets, can include the following features, characteristics, and/or uses: (1) indoor and outdoor use; (2) lightweight; (3) easy assembly and dissassembly; (4) compact when disassembled so easy for transportation; and (5) durability. A practice session that incorporates a hitting or catching net can be done with one or more participants. Buckets of balls are typically used per ball-hitting session and typically involve 30-80 balls. A typical ball-hitting session includes all of the balls being hit into the capture net and then manually picked up and placed back into the bucket for another round of hitting. This can be time consuming and can result in balls left behind in the net, which can damage the balls.

SUMMARY

Aspects of the current subject matter can include a sport ball capturing apparatus. In one aspect, the sport ball capturing apparatus can include a frame having a net support supported in a vertical orientation. The sport ball capturing apparatus can further include a first net portion coupled to the net support and extending a first length. The first net portion can include a proximal first portion end having a first perimeter and a distal first portion end having a second perimeter that is smaller than the first perimeter. The sport ball capturing apparatus can further include a second net portion extending a second length and including a proximal second portion end having a third perimeter that is coupled to the distal first portion end of the first net portion. The second net portion can include a distal dispensing end having a fourth perimeter and include a releasable restraining element that forms the dispensing end into a closed configuration when restrained and an open configuration when released.

In some variations one or more of the following features can optionally be included in any feasible combination. The second length can be greater than the first length. A first difference between the first and second perimeters can be greater than a second difference between the third and fourth perimeters. At least one of the first net portion and the second net portion can be made out of a flexible material. The open configuration of the distal dispensing end can allow at least one sport ball to pass through the distal dispensing end. The closed configuration of the distal dispensing end can prevent a sports ball from passing through the distal dispensing end. The coupling between the distal first portion end and the proximal second portion end can include a releasable coupling mechanism that allows the second net portion to be releasably coupled to the first net portion. The releasable coupling mechanism can include one or more of a Velcro, a zipper, and a clasping member. The proximal second portion end can include a second releasable restraining element that forms a second closed end when restrained and a second open end when released. The third and fourth perimeters can be equal. The second length can be at least twice as long as the first length. The distal dispensing end can form an opening that is at least three inches in diameter when in the open configuration. The releasable restraining element can include an elongated string intertwined with the distal dispensing end. The releasable restraining element can further include a releasable clasp that is adjustable by a user for securing at least one position along the elongated string for increasing or decreasing a length of the elongated string intertwined along the distal dispensing end. The releasable restraining element can be elastic. The first and second net portions can include at least one of a netting material, a mesh material, and a woven material. The net support can include a square perimeter or a circular perimeter. The frame can be made out of a rigid material. The at least one sport ball can include one or more of a baseball, a soccer ball, and a football.

In another interrelated aspect of the current subject matter, a method includes capturing a ball within a first net portion of a sport ball capturing device having a frame with a net support supported in a vertical orientation. The first net portion can be coupled to the net support. The method can further include capturing the ball within a second net portion coupled to the first net portion. The first net portion can extend a first length and include a proximal first portion end having a first perimeter and the second net portion can extend a second length and include a proximal second portion end coupled to a distal first portion end of the first net portion. The distal first portion end can include a second perimeter that is smaller than the first perimeter. The proximal second portion end can have a third perimeter, and the second net portion can include a distal dispensing end having a fourth perimeter and can include a releasable restraining element that forms the dispensing end into a closed configuration when restrained and an open configuration when released. The method can further include allowing at least one sport ball to dispense though the dispensing end when the dispensing end is in the open configuration.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Described herein include various implementations of a ball funneling net that can capture sport balls (e.g., baseballs, footballs, soccer balls) that a user directs into the ball funneling net. The ball funneling net can include a ball directing feature, such as a funnel, and a releasable restraining element that controls the balls from being released from a distal dispensing end of the ball capturing net. The ball funneling net can relieve a user from having to pick up balls that have been captured in the net and, instead, simply pick up a part of the ball directing feature and release the releasable restraining element. Once the releasable restraining element has been released or opened, any balls captured in the ball capturing net can exit the distal dispensing end of the ball directing feature or funnel. As such, the ball funneling net described herein can improve training efficiency in sports such as baseball and softball, as well as reduce damage to equipment and improve user experience.

The details of one or more variations of the subject matter described herein are set forth in the accompanying drawings and the description herein. While certain features of the currently disclosed subject matter are described for illustrative purposes in relation to a ball hitting net with a funneled target area and releasable closure, it should be readily understood that such features are not intended to be limiting. For example, the ball funneling net can be used with any number of sports to capture any number and type of balls and/or objects. The ball directing feature or funnel can be an extension of the ball funneling net or releasably coupled to a part of the ball funneling net. The ball funneling net can be supported by any number of structures, and can include a support structure integrated with the ball funneling net. The ball directing feature of the ball funneling net can extend between the surrounding structure or can include a diameter that is less than the support structure.

As used herein, "net" refers to any flexible, semi-flexible, or even rigid material that can capture balls sent into the net. The material can be a grid or other pattern of flexible strands connected to form what is commonly known as a net. The net can have any desired mesh size formed by the flexible strands. The net can also be a fabric, sheet, or other flexible material that does not form a mesh, but can still capture balls. Some or all of the net can contain rigid portions, such as for assisting with capturing or funneling balls.

Figure 1A:
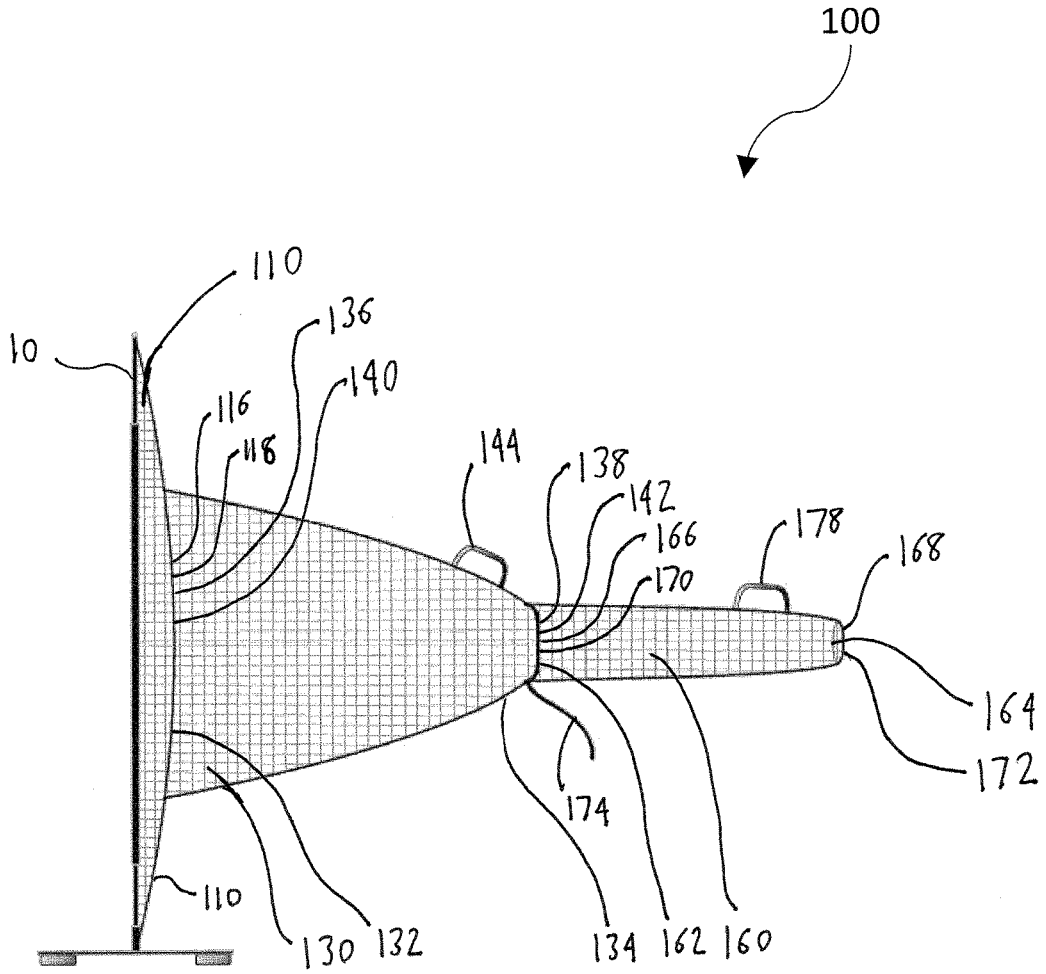
FIG. 1A is a side view of the ball funneling net consistent with implementations of the current subject matter.
Figure 1B:
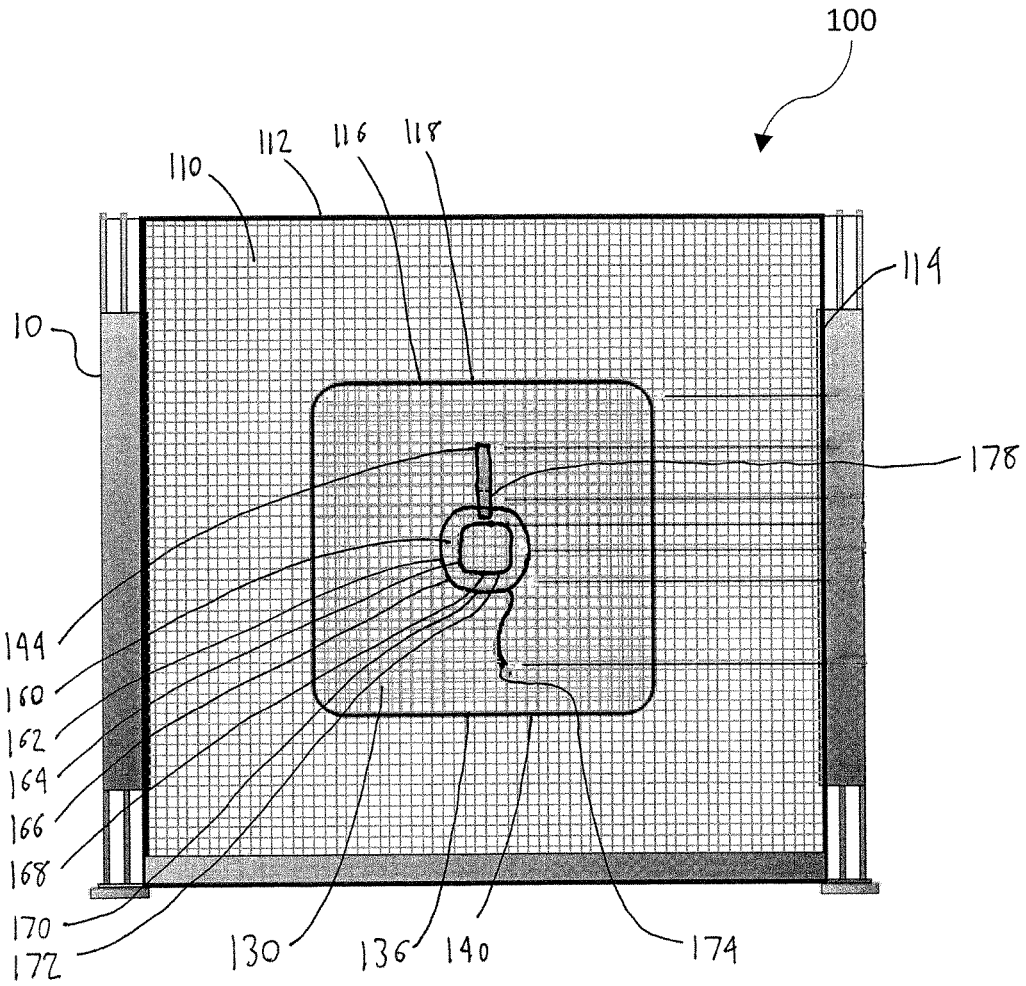
FIG. 1B is a front view of the ball funneling net consistent with implementations of the current subject matter.

FIG. 1A is a side view of the ball funneling net 100 consistent with implementations of the current subject matter. FIG. 1B is a front view of the ball funneling net 100 consistent with implementations of the current subject matter.

The ball funneling net 100 can be used to capture balls or other objects that are hit, thrown, or otherwise sent into the ball funneling net 100. The ball funneling net 100 can be used during practice sessions, or as part of a sporting event or leisure activity. As described herein, the ball funneling net 100 is described as being used to capture baseballs, however, this is not intended to be limiting. For example, the ball funneling net 100 can be used to capture softballs, tennis balls, footballs, soccer balls, and the like.

The ball capture net 100 can include a main net 110, a main sock 130, and a funnel sock 160. Balls that are captured within the ball funneling net 100 can be funneled through one or more of the main net 110, the main sock 130, and the funnel sock 160 for dispensing out of a distal end of the funnel sock (such as for collection into a receptacle). In some implementations, the funnel sock 160 can be detached and removable from the remainder of the ball capture net 100 and transported, with the balls enclosed therein, to any location desired by the user. For example, after hitting a number of baseballs into the ball capture net 100, the baseballs, once collected into the funnel sock 160, can be transported to a bucket or other receptacle to be used again.

As best seen in FIG. 1B, the main net 110 can have a perimeter 112 with one or more anchor points 114 that are connected to a support structure or frame 10 that can support the main net 110. The frame 10 can be rectangular, circular, comprise one or more posts, etc. The frame 10 can optionally be oriented horizontally similar to, for example, a baseball net, a driving net, a hockey net, etc. The frame 10 can optionally be oriented vertically, similar to, for example, a basketball net.

As shown in the example of FIG. 1A, the frame 10 can be oriented in a substantially vertical orientation. The main net 110, when connected to the frame 10 as shown, can capture balls that enter the main net 110. The main net 110 can be constructed with a generally concave shape which directs the balls entering the main net 110 to a ball receiving area 116, which can be located near the center. Corresponding to the shape of the frame 10, the main net 110 (or any of the nets described herein) can also be generally circular, rectangular, etc.

In some implementations, the main net 110 can include a main net aperture 118 within the ball receiving area 116. The main sock 130 can be connected to the main net aperture 118 to receive balls directly or directed from the main net 110 through the main net aperture 118. The main sock 130 can be a net similar or different to the main net 110, including having substantially the same or different transparency or mesh size. In other implementations, the main sock 130 can have a mesh size smaller than the main net 110. The main sock 130 can also have a concave or funnel-shape with a main sock proximal end 132 and a main sock distal end 134. The main sock 130 can also have a conical or tubular shape, with the main sock proximal end 132 being larger than the main sock distal end 134. The funnel shape can be straight, as with the frustrum of a cone, or curved or parabolic as shown in FIG. 1A.

The main sock proximal end 132 can be the end that is connected to the main net 110. The main sock proximal end 132 can include a main sock proximal perimeter 136 that defines a main sock proximal aperture 140 for receiving balls from the main net 110. In some implementations, the main sock proximal aperture 140 can be substantially the same size as the main net aperture 118. The main sock proximal aperture 140 can be limited by a main sock proximal perimeter 136 at the main sock proximal end 132.

The main sock can be connected to the main net 110 at the main sock proximal perimeter 136. The manner of connection can be permanent, such as sewing the main net 110 to the main sock 130 or forming the main net 110 and main sock 130 out of a single piece of netting. In other implementations, the main sock 130 can be detachable from the main net 110. The main net 110 and main sock 130 can be joined at one or more locations of the main sock proximal aperture 140 by fasteners, for example, snaps, buttons, hooks-and-loops, zippers, and the like.

The main sock 130 can have a main sock distal aperture 142 at the main sock distal end 134. In some implementations, the main sock distal aperture 142, formed by a main sock distal perimeter 138, can be smaller than the main sock proximal aperture 140. In these implementations, the main sock 130 can have a funnel-shape that is defined, in part, by the relative sizes of the main sock proximal aperture 140, the main sock distal aperture 142, and a length of the main sock 130.

The funnel sock 160 can be connected to the main sock 130 to receive balls from the main sock 130 via the main sock distal aperture 142. The funnel sock 160, similar to the main sock 130, can have a funnel sock proximal end 162 and a funnel sock distal end 164. The funnel sock proximal end 162 can include a funnel sock proximal perimeter 166 surrounding a funnel sock proximal aperture 170. The funnel sock proximal aperture 170 can be substantially the same size as the main sock distal aperture 142. Also, the funnel sock distal end 164 can include a funnel sock distal perimeter 168 surrounding a funnel sock distal aperture 172. The funnel sock 160 can also have a conical or tubular shape, with the funnel sock proximal end 162 larger than the funnel sock distal end 164. As with the main sock 130, the funnel shape can be straight, as with the frustrum of a cone, or curved or parabolic as shown in FIG. 1A. In the example of FIG. 1A, the funnel sock 130 can have a narrower and more tubular shape than the funnel shape shown for the main sock 130. In other implementations, there can be no narrowing of the funnel sock 160 between the funnel sock proximal end 162 and the funnel sock distal end 164. In such an implementation, the funnel sock 130 can be described as cylindrical in shape.

While the funnel sock 160 can be of any length, in some implementations the funnel sock 160 can have a length of between 3 and 5 feet, between 2 and 3 feet, or between 5 and 10 feet. Similarly, the funnel sock proximal aperture 170 and the funnel sock distal aperture 172 can be any size, but in some implementations the funnel sock proximal aperture 170 about one foot in diameter, six inches in diameter, or four inches in diameter. Similarly, the funnel sock distal aperture 172 can be about one foot in diameter, six inches in diameter, or four inches in diameter. In other implementations, to allow funneling of the balls, the funnel sock proximal aperture 170 can be about one foot in diameter and the funnel sock distal aperture 172 can be about four inches in diameter.

There can be a proximal closing mechanism 174 configured to close the funnel sock proximal aperture 170. In some implementations, the proximal closing mechanism 174 can be straps, a drawstring operating to constrict the proximal closing mechanism 174, buttons, zippers, hooks and loops fasteners (VELCRO), quick-release fasteners such as drawstrings with clasps, an elastic band that holds the funnel sock proximal aperture 170 in the closed position until pulled open by a user, etc. For example, the funnel sock proximal end 162 can be manipulated, by a user, to substantially close off the funnel sock 160 and substantially close the funnel sock proximal aperture 170 and the main sock distal aperture 142. The proximal closing mechanism 174 can then secure the funnel sock proximal perimeter 166 in a closed configuration such that no balls can enter or leave the funnel sock 160 through the funnel sock proximal perimeter 166. In some implementations, the proximal closing mechanism 174 can be integrated to the main sock distal end 134 and/or the funnel sock distal end 164. In other implementations, the ball funneling net 100 can include more than one closing mechanism, such as a closing mechanism for both the main sock 130 and the funnel sock 160.

Similar to the proximal closing mechanism 174, there can be a distal closing mechanism (not shown) configured to close the funnel sock distal aperture 172. The distal closing mechanism can include similar types of fasteners to those of the proximal closing mechanism 174.

As with the main sock 130, the funnel sock 160 can be connected to the main sock 130 at the funnel sock proximal perimeter 166. The manner of connection can be permanent, such as sewing the main sock 130 to the funnel sock 160 or forming the main sock 130 and funnel sock 160 out of a single piece of netting. In other implementations, the funnel sock 160 can be detachable from the main sock 130. The main sock 130 and funnel sock 160 can be joined at one or more locations of the funnel sock proximal aperture 170 by fasteners, for example, snaps, buttons, hooks-and-loops, zippers, and the like.

As described above, the ball capture net 100 can be used to capture and funnel balls into a container, such as a bucket, for ease of retrieval for further use. To aid in this use of the ball capture net 100, there can be one or more handles disposed on an outer surface of the ball capture net 100. In the implementation shown in FIGS. 1 and 2, there can be a main sock lifting handle 144 and a funnel sock lifting handle 178. The handles can be straps, rigid grips, and the like, connected to the outer surface to allow a user to grab and manipulate a portion of the ball capture net 100. In some implementations, the handles can be positioned proximate to the distal ends of the main sock 130 and/or the funnel sock 160. This can allow greater control over the position of their respective distal openings during use, as described below.

One method of use of the ball capture net 100 can include closing the main sock distal end 134 with the closing mechanism 174 to prevent balls from entering the funnel sock 160. When the main sock 130 contains one or more balls, the user can position the funnel sock distal end 164 into a bucket and lift the main sock 130 with the main sock lifting handle 144. To allow the balls to go from the main sock 130 to the funnel sock 160, the closing mechanism 174 can be opened thereby opening the main sock distal end 134. With the funnel sock distal end 164 also open (such as being always open or including a releasable closure that has been opened), the balls can pass from the main sock 130, through the funnel sock 160, and into the bucket.

An alternate method of use can be similar to the above, but with the funnel sock distal end 164 closed. When the main sock 130 is lifted with the main sock lifting handle 144, the balls can pour into the funnel sock 160 but be captured therein before being released into the bucket or otherwise out the funnel sock distal aperture 172. When a desired receptacle is in place, the funnel sock distal end 164 can be opened to allow the balls in the funnel sock 160 to transfer to the receptacle. Alternatively or in addition, the funnel sock 160 can be uncoupled from the main sock 130 to allow transport of the balls contained within the funnel sock 160 (such as by having one or more closures at either the proximal or distal end of the funnel sock 160.

While the examples given herein describe a three-stage funneling net, any number of stages can be added (or subtracted) with the features described herein applied to any or all of the stages. For example, the ball capture can include only the main net 110 and the main sock 130, with the main sock 130 allowing use of the main sock distal aperture 142 and main sock handle to pour balls into a receptacle.

In some implementations, the sport ball capturing device can include a frame having a net support supported in a vertical orientation. The sport ball capturing apparatus can further include a first net portion coupled to the net support and extending a first length. The first net portion can include a proximal first portion end having a first perimeter and a distal first portion end having a second perimeter that is smaller than the first perimeter. The sport ball capturing apparatus can further include a second net portion extending a second length and including a proximal second portion end having a third perimeter that is coupled to the distal first portion end of the first net portion. The second net portion can include a distal dispensing end having a fourth perimeter and include a releasable restraining element that forms the dispensing end into a closed configuration when restrained and an open configuration when released.

In some implementations of the sport ball capturing device, the second length can be greater than the first length. In addition, a first difference between the first and second perimeters can be greater than a second difference between the third and fourth perimeters, such as twice as great, three times as great, or more. At least one of the first net portion and the second net portion can be made out of a flexible material.

The open configuration of the distal dispensing end can allow at least one sport ball to pass through the distal dispensing end. As such, in the open configuration, the fourth diameter of the distal dispensing end is at least as big as a diameter of a sport ball (e.g., soccer ball, football, baseball, etc.). The closed configuration of the distal dispensing end can prevent the sports ball from passing through the distal dispensing end.

The coupling between the distal first portion end and the proximal second portion end can include a releasable coupling mechanism that allows the second net portion to be releasably coupled to the first net portion. The releasable coupling mechanism can include one or more of a Velcro, a zipper, and a clasping member. This can allow a user to efficiently release the second net portion from the first net portion, such as for transporting sport balls captured within the second net portion.

The proximal second portion end can include a second releasable restraining element that forms a second closed end when restrained and a second open end when released. This can prevent sport balls from being released from the proximal end of the second net portion, such as during transport of the second net portion. The third and fourth perimeters can be equal or the third perimeter can be greater than the fourth perimeter. The second length can be at least twice as long as the first length. The distal dispensing end can form an opening that is at least three inches in diameter when in the open configuration. Other dimensions have been contemplated, such as any diameter sufficient for allowing a sport ball to pass therethrough.

The releasable restraining element can include an elongated string intertwined with the distal dispensing end. The releasable restraining element can further include a releasable clasp that is adjustable by a user for securing at least one position along the elongated string for increasing or decreasing a length of the elongated string intertwined along the distal dispensing end. By shortening the length of string between ends secured by the clasp, the releasable restraining element can reduce the diameter able to be achieved by the distal dispensing end thereby assisting with forming the closed configuration of the distal dispensing end. The releasable restraining element can be elastic thereby allowing a user to expand the restraining element to allow sport balls to travel through the dispensing end and allowing the restraining element to contract to prevent such travel.

The first and second net portions can include at least one of a netting material, a mesh material, and a woven material.

The net support can include a square perimeter or a circular perimeter. The frame can be made out of a rigid material. The at least one sport ball can include one or more of a baseball, a soccer ball, and a football.

In another interrelated aspect of the current subject matter, a method includes capturing a ball within a first net portion of a sport ball capturing device having a frame with a net support supported in a vertical orientation. The first net portion can be coupled to the net support. The method can further include capturing the ball within a second net portion coupled to the first net portion. The first net portion can extend a first length and include a proximal first portion end having a first perimeter and the second net portion can extend a second length and include a proximal second portion end coupled to a distal first portion end of the first net portion. The distal first portion end can include a second perimeter that is smaller than the first perimeter. The proximal second portion end can have a third perimeter, and the second net portion can include a distal dispensing end having a fourth perimeter and can include a releasable restraining element that forms the dispensing end into a closed configuration when restrained and an open configuration when released. The method can further include allowing at least one sport ball to dispense though the dispensing end when the dispensing end is in the open configuration. In addition, the method can further include preventing at least one sport ball from dispensing though the dispensing end when the dispensing end is in the closed configuration.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above.

What is claimed is:

1. A sport ball capturing apparatus, comprising:

a frame having a net support supported in a vertical orientation;

a first net portion coupled to the net support and extending a first length, the first net portion including a proximal first portion end having a first perimeter and a distal first portion end having a second perimeter that is smaller than the first perimeter; and a second net portion extending a second length and including a proximal second portion end having a third perimeter that is coupled to the distal first portion end of the first net portion, the second net portion including a distal dispensing end having a fourth perimeter and including a first releasable restraining element that forms the distal dispensing end into a closed configuration when restrained and an open configuration when released, the proximal second portion end including a second releasable restraining element that forms the closed configuration when restrained and the open configuration when released;

wherein when the first releasable restraining element and the second releasable restraining element are restrained and thereby form the closed configuration, the second net portion is configured to contain at least one sports ball between the first releasable restraining element and the second releasable restraining element, and wherein when the first releasable restraining element and the second releasable restraining element are released and thereby form the open configuration, the second net portion is configured to allow the at least one sports ball to enter or exit the second net portion.

2. The sport ball capturing apparatus of claim 1, wherein the second length is greater than the first length.

3. The sport ball capturing apparatus of claim 1, wherein a first difference between the first perimeter and the second perimeter is greater than a second difference between the third perimeter and the fourth perimeter.

4. The sport ball capturing apparatus of claim 1, wherein at least one of the first net portion and the second net portion is made out of a flexible material.

5. The sport ball capturing apparatus of claim 1, wherein the open configuration of the distal dispensing end allows at least one sport ball to pass through the distal dispensing end.

6. The sport ball capturing apparatus of claim 5, wherein the at least one sport ball includes one or more of a baseball and a soccer ball.

7. The sport ball capturing apparatus of claim 1, wherein the closed configuration of the distal dispensing end prevents a sports ball from passing through the distal dispensing end.

8. The sport ball capturing apparatus of claim 1, wherein the coupling between the distal first portion end and the proximal second portion end includes a releasable coupling mechanism that allows the second net portion to be releasably coupled to the first net portion.

9. The sport ball capturing apparatus of claim 8, wherein the releasable coupling mechanism includes one or more of a Velcro, a zipper, and a clasping member.

10. The sport ball capturing apparatus of claim 1, wherein the third perimeter and the fourth perimeter are equal.

11. The sport ball capturing apparatus of claim 1, wherein the second length is at least twice as long as the first length.

12. The sport ball capturing apparatus of claim 1, wherein the distal dispensing end forms an opening that is at least three inches in diameter when in the open configuration.

13. The sport ball capturing apparatus of claim 1, wherein the first releasable restraining element includes an elongated string intertwined with the distal dispensing end, the first releasable restraining element further including a releasable clasp that is adjustable by a user for securing at least one position along the elongated string for increasing or decreasing a length of the elongated string intertwined along the distal dispensing end.

14. The sport ball capturing apparatus of claim 1, wherein the first releasable restraining element is elastic.

15. The sport ball capturing apparatus of claim 1, wherein the first net portion and the second net portion include at least one of a netting material, a mesh material, and a woven material.

16. The sport ball capturing apparatus of claim 1, wherein the net support includes a square perimeter or a circular perimeter.

17. The sport ball capturing apparatus of claim 1, wherein the frame is made out of a rigid material.

18. A method of a sport ball capturing apparatus, comprising:

capturing a ball within a first net portion of a sport ball capturing device having a frame with a net support supported in a vertical orientation, the first net portion being coupled to the net support;

capturing the ball within a second net portion coupled to the first net portion, the first net portion extending a first length and including a proximal first portion end having a first perimeter and the second net portion extending a second length and including a proximal second portion end coupled to a distal first portion end of the first net portion, the distal first portion end including a second perimeter that is smaller than the first perimeter, the proximal second portion end having a third perimeter, and the second net portion including a distal dispensing end having a fourth perimeter and including a releasable restraining element that forms the distal dispensing end into a closed configuration when restrained and an open configuration when released, the proximal second portion end including a second releasable restraining element that forms the closed configuration when restrained and the open configuration when released;

wherein when a first releasable restraining element and the second releasable restraining element are restrained and thereby form the closed configuration, the second net portion is configured to contain at least one sports ball between the first releasable restraining element and the second releasable restraining element, and wherein when the first releasable restraining element and the second releasable restraining element are released and thereby form the open configuration, the second net portion is configured to allow the at least one sports ball to enter or exit the second net portion;

allowing at least one sport ball to dispense though the distal dispensing end when the distal dispensing end is in the open configuration.

19. The method of claim 18, further comprising: preventing at least one sport ball from dispensing though the distal dispensing end when the distal dispensing end is in the closed configuration.

* * * * *